United States Patent [19]

Clapp et al.

[11] Patent Number: 4,941,484

[45] Date of Patent: Jul. 17, 1990

[54] TOBACCO PROCESSING

[75] Inventors: William L. Clapp; Barry S. Fagg, both of Winston-Salem, N.C.

[73] Assignee: R. J. Reynolds Tobacco Company, Winston-Salem, N.C.

[21] Appl. No.: 358,725

[22] Filed: May 30, 1989

[51] Int. Cl.[5] ..... A24B 15/20; A24B 15/24

[52] U.S. Cl. ..... 131/297; 131/308

[58] Field of Search ..... 131/297, 298, 308

[56] References Cited

U.S. PATENT DOCUMENTS

| | | |
|---|---|---|
| 1,294,310 | 2/1919 | Sayre et al. . |
| 3,132,651 | 5/1964 | Kiefer . |
| 3,240,214 | 3/1966 | Bavley et al. . |
| 3,513,857 | 5/1970 | Silberman . |
| 3,636,097 | 1/1972 | Harvey . |
| 3,747,608 | 7/1973 | Gravely et al. . |
| 3,847,163 | 11/1974 | Molyneux . |
| 4,135,521 | 1/1979 | Malan et al. . |
| 4,289,147 | 9/1981 | Wildman et al. . |
| 4,307,733 | 12/1981 | Teng et al. . |
| 4,308,877 | 1/1982 | Mattina . |
| 4,347,324 | 8/1982 | Wildman et al. . |
| 4,364,401 | 12/1982 | Keritsis . |
| 4,407,307 | 10/1983 | Gaisch et al. . |
| 4,476,881 | 10/1984 | Gravely et al. . |
| 4,537,204 | 8/1985 | Gaisch et al. . |
| 4,572,219 | 4/1986 | Gaisch et al. . |
| 4,700,727 | 10/1987 | Torigian . |
| 4,709,710 | 12/1987 | Gaisch et al. . |
| 4,716,911 | 1/1988 | Poulose et al. . |

FOREIGN PATENT DOCUMENTS

| | | |
|---|---|---|
| 117189 | 8/1984 | European Pat. Off. . |
| 2069814 | 10/1981 | United Kingdom . |

*Primary Examiner*—V. Millin

[57] ABSTRACT

Tobacco material having a reduced protein content is provided by first extracting water soluble components from tobacco. The extracted residue then is subjected to enzyme treatment using an enzyme which can decompose water insoluble protein molecules to smaller sized water soluble molecular components. The enzyme treated extracted tobacco material then is isolated. The extracted tobacco components then are subjected to ultrafiltration treatment, and the extracted tobacco components having the high molecular weight components thereof so removed are reapplied to the protein-reduced tobacco material. As such, a reconstituted tobacco material is provided. The reconstituted tobacco material so provided is useful as smokable material for cigarette manufacture.

15 Claims, 2 Drawing Sheets

TOBACCO PROCESSING

BACKGROUND OF THE INVENTION

The present invention relates to a process for the preparation of tobacco having a reduced protein content.

Cigarettes are popular smoking articles which have a substantially cylindrical rod shaped structure and include a charge of tobacco (i.e., in cut filler form) surrounded by a paper wrapper thereby forming a tobacco rod. Popular cigarettes include blends of tobacco materials. Some cigarettes have cylindrical filters aligned in an end-to-end relationship with the tobacco rod. Typically, filters are manufactured from fibrous materials such as cellulose acetate and are attached to the tobacco rod using a circumscribing tipping material.

Recently, there has been interest in improving the smoking quality of tobacco. For example, U.K. Patent Application No. 2,069,814 as well as U.S. Pat. Nos. 4,407,307 and 4,537,204 to Gaisch et al, and 4,716,911 to Poulose et al propose processes for reducing the protein content of tobaccos. The proposed processes involve subjecting tobacco to enzymatic treatment in order to reduce the protein content of the tobacco.

It would be desirable to provide a process for efficiently and effectively providing tobacco having a reduced protein content.

SUMMARY OF THE INVENTION

The present invention relates to a process for reducing the protein content of tobacco. The process involves five steps.

The first step involves extracting components from tobacco material with a solvent having an aqueous character.

The second step involves separating the resulting extracted tobacco components (i.e., the liquid portion) from the extracted tobacco material (i.e., the insoluble portion).

The third step involves subjecting the extracted tobacco material to aqueous enzyme treatment in order to decompose effective amounts of the essentially water insoluble nitrogen-containing (e.g., protein) components of that tobacco material into water soluble and/or dispersible fragments. The tobacco material so treated then is separated from the aqueous liquid, enzyme treatment components, and water soluble and water dispersible protein fragments; thereby isolating protein-reduced tobacco material.

The fourth step involves subjecting the extracted tobacco components within the solvent having an aqueous character to membrane treatment which is sufficient to remove a significant portion of high molecular weight extracted components from within the solvent. The removal of the significant portion of high molecular weight extracted components preferably is provided using ultrafiltration techniques, or the like; and permeate resulting from such treatment is collected. The permeate includes the solvent and water soluble extracted tobacco components having a molecular weight below that of the nominal molecular weight cut off value of the particular membrane employed to perform the membrane treatment.

The fifth step involves combining the protein-reduced tobacco material with the extracted tobacco components which have had a significant portion of the high molecular weight extracted components removed therefrom. As such, a reconstituted tobacco material having a low protein content can be provided.

The process of this invention provides the skilled artisan with an efficient and effective method for obtaining processed tobacco having a reduced protein content. Tobacco materials so processed are useful as smokable materials for the manufacture of cigarettes and other smoking articles.

DETAILED DESCRIPTION OF THE PREFERRED EMBODIMENTS

Figure 1:
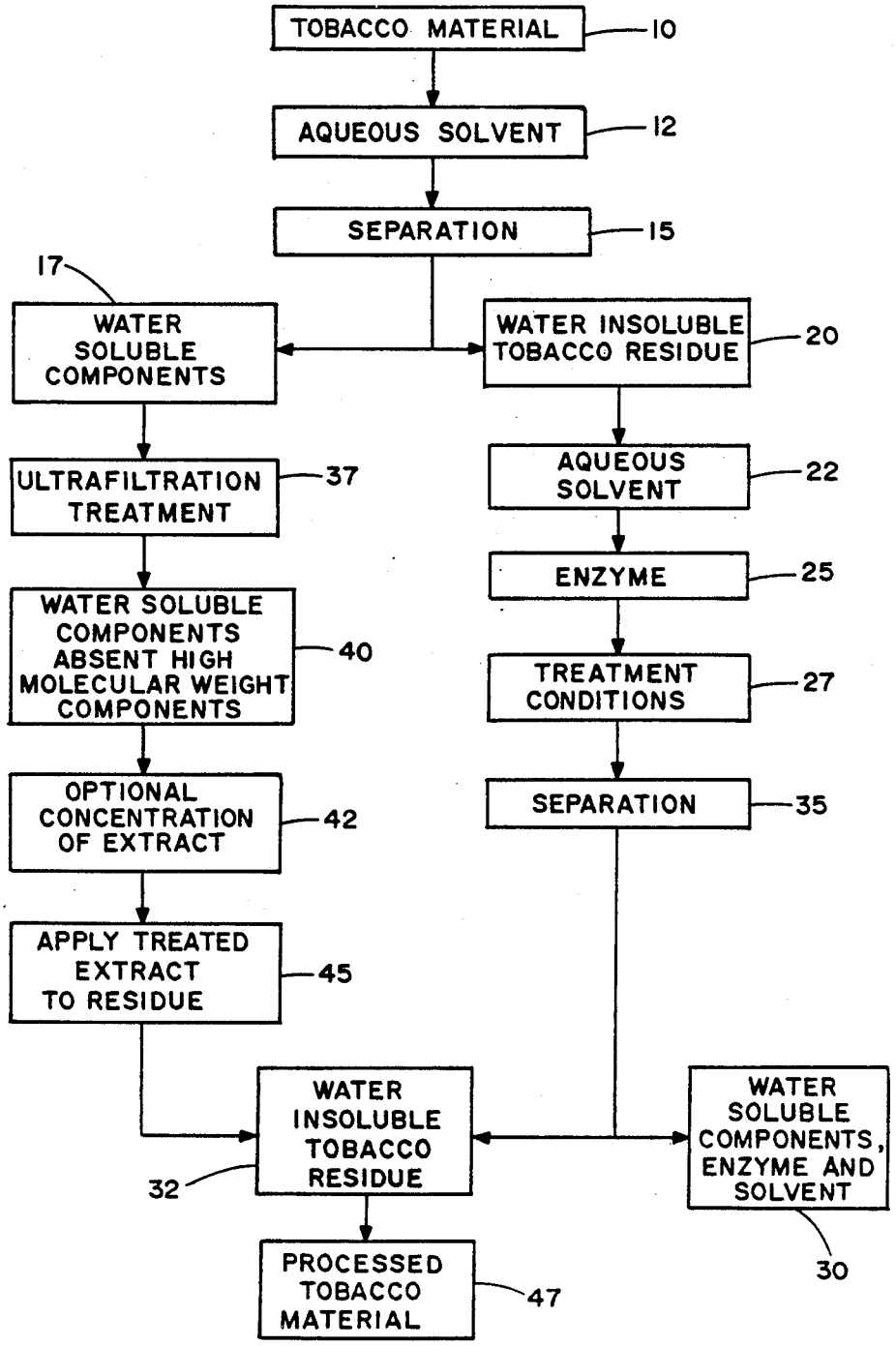
FIG. 1 is a schematic diagram of the process steps representative of one embodiment of this invention.

Referring to FIG. 1, tobacco material 10 is contacted with an aqueous solvent 12. As a result, water soluble components are extracted from the tobacco by the solvent. The mixture is subjected to separation conditions 15 so as to provide an aqueous solution 17 of water soluble tobacco components and a water insoluble residue 20 of extracted tobacco material. The solution of extracted tobacco components may contain enzyme inhibitors which are naturally present in the tobacco. The extracted tobacco material 20 is contacted with a second aqueous solvent 22, and the mixture is further contacted with enzyme 25. The extracted tobacco material 20, aqueous solvent 22 and enzyme 25 are maintained in contact under conditions 27 such that the enzyme can decompose protein components of the tobacco (e.g., by hydrolysis) to smaller sized molecular components. The aqueous portion containing spent enzyme and water soluble and water dispersible decomposed protein components 30, and the insoluble tobacco residue 32, are subjected to a separation step 35 in order to isolate the remaining insoluble tobacco residue 32. The remaining residue 32 has a reduced protein content relative to extracted tobacco material 20.

The aqueous solution 17 of water soluble tobacco components is subjected to membrane treatment 37, such as ultrafiltration treatment, sufficient to remove a substantial portion of high molecular weight (i.e., relatively large sized) extracted components from within the solvent thereby yielding an aqueous solution 40 of water soluble tobacco components absent of a substantial portion of the high molecular weight extracted components. The treatment of the water soluble tobacco components is described in greater detail hereinafter with reference to FIG. 2. If desired, the aqueous solution of water soluble tobacco components so treated is concentrated 42 (e.g., using a wipe film evaporator, or the like). The aqueous solution of water soluble tobacco components then is combined with the water insoluble tobacco residue. For example, the treated water soluble tobacco components are applied 45 to the water insoluble tobacco residue 32. In particular, a reconstituted tobacco 47 can be provided using a papermaking process, a cast sheet process, or the like. The resulting processed tobacco material 47 has a reduced protein content relative to that of the starting tobacco material 10.

Figure 2:
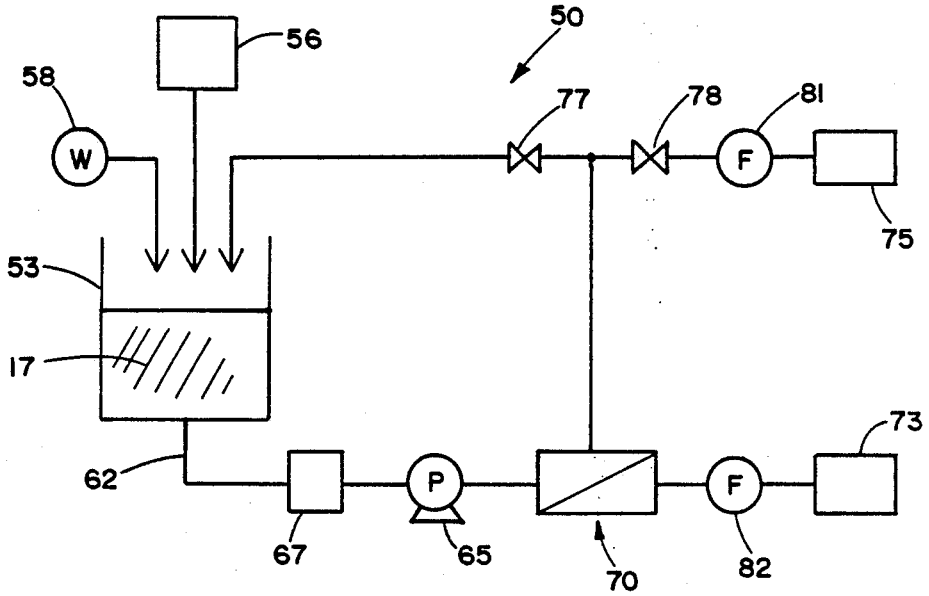
FIG. 2 is a schematic diagram of an apparatus for carrying out a portion of the steps of the process of the present invention.

Referring to FIG. 2, there is shown an apparatus 50 for subjecting the aqueous solution 17 of water soluble tobacco components to ultrafiltration treatment. The apparatus 50 includes a polyethylene tank 53, or other suitable reservoir for containment of the aqueous solution 17. The aqueous solution 17 is fed from a feed reservoir 56 into tank 53. Water source 58 provides a source of water for introduction into tank 53 to dilute the aqueous solution 17, if dilution of such solution is desirable or necessary.

The aqueous solution 17 is transferred from tank 53 through tube 62 by the action of pump 65 such as a high pressure piston feed pump. A filter cartridge 67, such as a 50 micron fiber filter cartridge, can be positioned between the tank 53 and the pump 65 in order to remove fine and coarse suspended particulate matter from the aqueous solution. The pump 65 provides for flow of the aqueous solution 17 through a reverse osmosis or ultrafiltration module 70. Desirable permeate exits the module 70 and is collected in a permeate reservoir 73. The concentrate, which includes high molecular weight components of the aqueous solution, is either collected in concentrate reservoir 75 or returned to tank 53 and recycled. Whether the concentrate is collected or recycled depends upon the setting of valves 77, 78. Flow indicators 81, 82 provide for an indication of the amounts of permeate and concentrate, respectively, which are collected.

The apparatus 50 shown in FIG. 2 preferably is equipped with temperature indicators, pressure indicators, heat exchangers, valves and relief valves, liquid level sensing switches (not shown), and other desirable components which ensure smooth operation of the apparatus. Operation of such an apparatus will be apparent to the skilled artisan.

The tobacco material can vary. Examples of suitable tobaccos include flue-cured, Burley, Maryland, and Oriental tobaccos, as well as the rare or specialty tobaccos. Typically, the tobacco has been aged. The tobacco material can be in the form of leaf, laminae and/or stem, or can be in a processed form. For example, the tobacco material can be subjected to volume expansion conditions. Tobacco waste materials and processing by-products such as fines, dust, scrap, stems and stalks can be employed. The aforementioned materials can be processed separately, or as blends thereof.

The tobacco material can have a variety of sizes for extraction. For example, the tobacco can be in strip form or cut filler form. Tobacco materials in strip or cut filler form are desirable in that the spent materials which remain after the extraction step can be dried and further employed in the manufacture of smokable materials. Alternatively, the tobacco can be ground to a powder of fine size. Small particle size tobacco materials are desirable in order to provide for increased extraction efficiency as well as decrease the time period over which extraction may occur.

The tobacco material is contacted with a first solvent having an aqueous character. Such a solvent consists primarily of water, and can be essentially pure water in certain circumstances. For example, a solvent having an aqueous character can be distilled water, tap water, or the like. However, the solvent can include water having substances such as pH buffers or the like dissolved therein. The solvent also can be a co-solvent mixture of water and minor amounts of one or more solvents which are miscible therewith. An example of such a co-solvent mixture is a solvent consisting of 95 parts water and 5 parts ethanol. An example of another co-solvent mixture is a solvent consisting of 90 parts water and 10 parts ethanol.

The amount of tobacco material which is contacted with the first solvent can vary. Typically, the weight of solvent relative to the tobacco material is greater than 6:1, oftentimes greater than 8:1 and in certain instances greater than 12:1. The amount of solvent relative to tobacco material depends upon factors such as the type of solvent, the temperature at which the extraction is performed, the type or form of tobacco which is extracted, the manner in which contact of the tobacco material and solvent is conducted, and other such factors. The manner of contacting the tobacco material and first solvent is not particularly critical.

The conditions under which the first extraction is performed can vary. Typical temperatures range from about 5° C. to about 75° C., with about 15° C. to about 30° C. being preferred, and ambient temperature being especially preferred. The solvent/tobacco material mixture can be agitated (e.g., stirred, shaken or otherwise mixed) in order to increase the rate at which extraction occurs. Typically, adequate extraction of components occurs in less than about 60 minutes, oftentimes less than about 30 minutes. The tobacco material can be subjected to a continuous aqueous extraction, if desired.

A wide variety of materials or components can be extracted from the tobacco materials. The particular materials and the amounts of the particular materials which are extracted often depend upon the type of tobacco which is processed, the properties of the particular solvent, and the extraction conditions (e.g., which include the temperature at which the extraction occurs as well as the time period over which an extraction is carried out). For example, a solvent consisting essentially of pure water will most often extract primarily the water soluble components of the tobacco material, while a co-solvent mixture of water and a minor amount of an alcohol can extract the water soluble components of the tobacco material as well as certain amounts of components having other solubility characteristics.

The solvent and extracted components are separated from the insoluble residue. The manner of separation can vary; however, it is convenient to employ conventional separation means such as filtration, centrifugation, or the like. Preferably, the insoluble residue is separated from as much of the extracted tobacco components as is possible. For example, the residue can be pressed or squeezed to remove solvent and extracted components therefrom. The residue then can be (i) used as such, or (ii) drum dried, subjected to a freeze drying operation, or subjected to any other suitable type of drying step.

The insoluble residue is contacted with a second liquid having an aqueous character. Aqueous solvents advantageously are employed due to the fact that enzymatic activity is effective using at least some water as liquid medium. Typically, the weight of the liquid relative to the tobacco residue is greater than about 10:1, and is often greater than about 12:1. The amount of liquid medium relative to tobacco material depends upon factors such as the type, form or size of the tobacco material, the particular enzyme employed, the particular enzyme activity, and the like.

The conditions under which the enzyme treatment is performed depends upon factors such as the pH of the aqueous medium, the temperature of the liquid medium and tobacco residue, the concentration of the enzyme, the amount of liquid medium relative to the tobacco residue, and the like. Typically, the pH of the aqueous medium is between about 7 and about 8.5, for most applications. Generally, the temperature of the liquid medium and tobacco residue is between about 25° C. and 60° C. during enzyme treatment.

The enzyme employed is an enzyme which can digest or decompose protein to smaller sized molecular components. Typically, the enzyme is a solubilizing protease. Examples of proteases which can be used include dispase, protease K, pronase, thermolysin, trypsin, chymotrypsin, bromelain, subtilisin, proteinase, papain, rhozyme proteases, and the like. If desired, combinations of proteases can be employed for effective enzyme treatment. Additionally, a series of enzyme treatments can be performed using different enzymes under different types of treatment conditions.

The amount of enzyme employed relative to the tobacco material can vary. Generally, for cost effective use of the enzyme, it is desirable to employ sufficient amount of enzyme under conditions such that the tobacco protein will be reduced by about 50 percent before the enzyme loses 90 percent of its original activity. As such, the amount of enzyme employed can be determined by experimentation. The time period over which enzyme treatment occurs typically is between about 1 hour and about 8 hours.

If desired, the tobacco material (e.g., tobacco residue) can be subjected to additional enzyme treatment prior to or simultaneous to the protease enzyme treatment. For example, the tobacco residue can be subjected to enzyme treatment using a depolymerase enzyme such as cellulase, pectinase, lipase, ligninase, cutinase, amylase, or the like. Treatment of the tobacco residue using depolymerase enzymes can provide for an efficient treatment using the protease enzyme. Conditions for treating the tobacco residue with the depolymerase enzyme will be apparent to the skilled artisan.

The enzymatic treatment of the tobacco material results in the decomposition of protein fragments. Many of the resulting protein fragments are solubilized and/or dispersed in the liquid medium, and hence are readily separated from the tobacco residue. As such, the protein is provided in such a form that a significant amount thereof conveniently is removed from the tobacco material.

The liquid medium is separated from the treated insoluble tobacco residue using centrifugation techniques, or the like. As such, the treated insoluble residue is isolated; and the liquid medium containing the decomposed protein fragments can be collected and discarded. In particular, the insoluble residue is separated from a majority or essentially all of the liquid medium and water soluble and water dispersible decomposed protein fragments so as to isolate the extracted tobacco material (i.e., the insoluble tobacco residue). The liquid medium and insoluble residue can be heated or otherwise processed to terminate the activity of the enzyme prior to or during the separation steps. If desired, the tobacco residue can be washed with an aqueous liquid to further remove therefrom as much of the decomposed protein fragments as possible.

The insoluble residue can be dried to a low moisture content using freeze drying techniques, or the like. Alternatively, the treated residue can be used directly, and recombined with the treated aqueous extract to provide a reconstituted tobacco material using conventional techniques such as cast sheet processes, paper making processes, extrusion processes, dry reconstitution processes, or the like.

The aqueous solution of water soluble and/or dispersible tobacco components is subjected to treatment sufficient to remove significant quantities of high molecular weight tobacco components therefrom. Typical of such high molecular weight components are water soluble and/or dispersible polypeptides and proteins.

The preferred manner for removing the desired quantities of high molecular weight components from the aqueous solution involves the use of a membrane treatment such as ultrafiltration or reverse osmosis techniques. In particular, the aqueous solution of tobacco components which permeates a particular membrane is collected and employed in further process steps of the invention; and the high molecular weight components which are rejected by the membrane (i.e., which do not permeate the membrane) are collected and discarded.

The membrane which is employed to provide an aqueous solution of water soluble tobacco components having the high molecular weight water soluble components removed therefrom can vary. For example, membrane modules can include tubular modules, spiral wound modules and hollow fiber modules made from homogeneous polymeric materials such as cellulose acetate, polyamides and polysulfones. An especially preferred membrane is a spiral wound module available as a G-series Module from Desalination Systems, Inc.

The molecular weight range which is rejected by (i.e., which does not permeate) a membrane which is employed according to the process of this invention can vary. For example, it may be desirable to employ a membrane which rejects a high percentage (e.g., greater than about 95 weight percent) of all components having a molecular weight in excess of a particular molecular weight cut off; while permitting permeation of a high percentage of components having a molecular weight below the molecular weight cut off. Typical nominal molecular weight cut off values for membranes useful according to the process of this invention sometimes are in excess of 3,000, occasionally are in excess of 5,000, often are in excess of 10,000, and frequently are in excess of 15,000. However, typical nominal molecular weight cut off values for membranes useful according to this invention do not exceed 30,000 in order that a significant amount of certain components having a molecular weight of less than 30,000 are removed from the aqueous solution. The selection of a membrane having a particular nominal molecular weight cut off will depend upon the particular application and will be apparent to the skilled artisan.

The dissolved solids content of the aqueous solution of tobacco components prior to membrane treatment can vary. Typically, the dissolved solids content of the aqueous solution ranges from greater than 0 to about 50 weight percent; oftentimes from about 3 to about 40 weight percent; and preferably from about 15 to about 30 weight percent.

In the highly preferred embodiments of the present invention, the aqueous solution of tobacco components is not required to be subjected to any enzymatic treatment.

At least a portion of the aqueous solution of water soluble tobacco components which has had the high molecular weight components removed therefrom is applied to the water insoluble , protein-reduced tobacco residue. In particular, the aqueous solution of tobacco components which permeate the membrane can be applied as such to the tobacco residue; concentrated using wipe film evaporation techniques prior to application to the tobacco residue; spray dried or freeze dried prior to application; treated or otherwise processed to remove selected components such as potassium nitrate prior to application; or the like. Representative freeze drying and spray drying processes are set forth in U.S. Pat. Nos. 3,316,919 to Green and 3,398,754 to Tughan. It often is convenient to dry the treated tobacco residue prior to the time that the aqueous solution of extracted components is applied thereto. For example, the treated tobacco residue in the form of strip or cut filler, or which is reformed using a reconstitution process, can be dried to a moisture level of less than about 15 weight percent; and then the aqueous solution of extracted tobacco components can be applied thereto. As another example, a papermaking technique for providing reconstituted tobacco can be employed (i.e. the treated tobacco residue can be formed into a sheet, the treated tobacco extract can be sprayed onto the sheet and the resulting mixture is dried). Alternatively, the treated tobacco residue and the treated tobacco extract can be recombined and formed into a reconstituted tobacco material using a cast sheet process. Manners and methods for drying the treated tobacco residue and the treated tobacco extract applied thereto will be apparent to the skilled artisan. Typically, the treated tobacco residue and treated extract combined therewith are dried to a moisture level of about 12 to about 13 weight percent for use as a smokable reconstituted tobacco material.

The following examples are provided in order to further illustrate various embodiments of the invention but should not be construed as limiting the scope thereof. Unless otherwise noted, all parts and percentages are by weight.

EXAMPLE 1

A blend of aged flue cured, Burley and Oriental tobaccos in cut filler form is extracted with water at a temperature of 25° C. and agitated for 30 minutes. The water is absent of added enzymatic material. In particular, 35 pounds of tobacco is mixed with 50 gallons of water. The mixture then is centrifuged to yield a wet residue weighing about 85 pounds. The liquid portion containing the extracted tobacco components is collected for later processing steps. The wet residue is dried using a fluidized bed dryer to yield about 20 pounds of dried extracted tobacco material. A second extraction of a similar blend of cut filler is performed by mixing 45 pounds of tobacco with 70 gallons of water at a temperature of 25° C. and agitation for 30 minutes. The mixture then is centrifuged to yield about 160 pounds of wet tobacco residue. The liquid portion obtained during the second extraction is discarded.

Into 65 gallons of water is charged the 20 pounds of the dried extracted tobacco material and 60 pounds of the wet tobacco residue. The mixture is maintained at 50° C. and buffered to a pH of 8.0 using a sodium hydroxide solution. Into the mixture is charged 200 g of enzyme EC3.4.21.14 having a specific activity of 2.4 AU/g followed by the wet tobacco residue. One Anson Unit (AU) is the amount of enzyme which, under standard conditions, digests hemoglobin at an initial rate liberating per minute an amount of trichloroacetic acid soluble product which gives the same color with phenol reagent as one milliequivalent of tyrosine. The resulting mixture is agitated at 50° C. for about 4.5 hours, while the pH is monitored and maintained at about 8.0.

The mixture then is centrifuged, mixed with 70 gallons of water and agitated for about 15 minutes, and centrifuged again. The resulting wet residue is rinsed in the centrifuge with 100 gallons of water. The wet residue then is dried to yield about 25 pounds of an enzyme treated tobacco residue.

The protein nitrogen content of the resulting enzyme treated tobacco residue is 0.41 percent, based on the dry weight of the tobacco. The protein nitrogen content of the water extracted tobacco material prior to enzyme treatment is 1.37 percent, based on the dry weight of the tobacco. Hence, about 70 percent of the protein content of the tobacco material is removed therefrom as a result of enzymatic treatment.

The liquid portion containing the extracted tobacco components is subjected to membrane treatment. In particular, 43 gallons of the liquid portion is processed using an ultrafiltration membrane available as G-50 membrane from Desalination Systems, Inc. The operating pressure of the liquid portion initially is 175 psi, and the pressure gradually is increased to about 240 psi over time to maintain a relatively constant permeate flow rate. As a result, 30 gallons of permeate and 13 gallons of concentrate are collected. The concentrate is discarded, and the permeate is concentrated using a wipe film evaporator to produce 3.75 gallons of permeate having a dissolved solids content of 166.1 g/1.

The tobacco residue and extract are recombined. In particular, 11 pounds of the enzymatically treated tobacco residue are combined with 3.75 gallons of the concentrated permeate. The resulting mixture is heated to about 80° C. with stirring for about 30 minutes. The mixture then is passed three times through a Reitz Laboratory Disintegrator. The mixture then is cast onto a stainless steel belt having a temperature of about 300° C., and results in sheets having a thickness of about 0.5 mm. The resulting reconstituted tobacco sheets are dried so as to have a moisture content of about 12 percent, cut into cut filler form, and used in the manufacture of cigarettes. Cigarettes provided using such reconstituted tobacco material have a mild smoking character.

What is claimed is:

1. A process for reducing the protein content of tobacco material, the process comprising:
   (i) extracting components from tobacco material with a solvent having an aqueous character;
   (ii) separating extracted tobacco components from extracted tobacco material;
   (iii) subjecting the extracted tobacco material to aqueous enzyme treatment to decompose essentially water insoluble protein components of the tobacco material to water soluble and/or water dispersible fragments; and separating tobacco material subjected to such treatment from decomposed protein fragments resulting from such treatment;
   (iv) subjecting the extracted tobacco components to membrane treatment and collecting permeate resulting from such treatment; and
   (v) contacting the extracted tobacco material resulting from step (iii) with the permeate collected in step (iv).

2. The process of claim 1 whereby the permeate collected in of step (iv) then is subjected to a spray drying operation, and resulting spray dried material is contacted with the extracted tobacco material of step (iii).

3. The process of claim 1 further comprising subjecting the extracted tobacco material to aqueous enzyme treatment with a depolymerase enzyme prior to or simultaneous to the enzyme treatment of step (iii).

4. The process of claim 1 whereby the extracted tobacco of step (ii) is subjected to enzyme treatment sufficient to reduce the protein content thereof by more than 50 weight percent.

5. The process of claim 1 whereby the extracted tobacco of step (ii) is subjected to enzyme treatment sufficient to reduce the protein content thereof by more than 70 weight percent.

6. The process of claim 1 whereby the tobacco material includes Burley tobacco.

7. The process of claim 1, 3 or 4 whereby the extracted tobacco components are subjected to membrane treatment using an ultrafiltration membrane.

8. The process of claim 1, 3 or 4 whereby the extracted tobacco components are subjected to membrane treatment using a membrane having a nominal molecular weight cut off value of in excess of about 3,000.

9. The process of claim 1, 3 or 4 whereby the extracted tobacco components are subjected to membrane treatment using a membrane having a nominal molecular weight cut off value of in excess of about 5,000.

10. The process of claim 1, 3 or 4 whereby the extracted tobacco components are subjected to membrane treatment using a membrane having a nominal molecular weight cut off value of in excess of about 10,000.

11. The process of claim 1, 3 or 4 whereby the extracted tobacco components are subjected to membrane treatment using a membrane having a nominal molecular weight cut off value of in excess of about 15,000.

12. The process of claim 1, 3 or 4 whereby the extracted tobacco material resulting from step (iii) is contacted with the permeate collected in step (iv), and the resulting mixture of extracted tobacco material and permeate is dried to a moisture level of about 12 to about 13 weight percent.

13. The process of claim 8 whereby the extracted tobacco material resulting from step (iii) is contacted with the permeate collected in step (iv), and the resulting mixture of extracted tobacco material and permeate is dried to a moisture level of about 12 to about 13 weight percent.

14. The process of claim 1, 3 or 4 whereby the extracted tobacco components are subjected to membrane treatment using a membrane having a nominal molecular weight cut off value of in excess of about 3,000 but not in excess of about 30,000.

15. The process of claim 14 whereby the extracted tobacco material resulting from step (iii) is contacted with the permeate collected in step (iv), and the resulting mixture of extracted tobacco material and permeate is dried to a moisture level of about 12 to about 13 weight percent.

* * * * *